US009466277B1

(12) United States Patent
Myers

(10) Patent No.: US 9,466,277 B1
(45) Date of Patent: Oct. 11, 2016

(54) ADJUSTABLE DIRECTIVITY ACOUSTIC PICKUP FOR MUSICAL INSTRUMENTS

(71) Applicant: Gregg Allen Myers, Garden Grove, CA (US)

(72) Inventor: Gregg Allen Myers, Garden Grove, CA (US)

( * ) Notice: Subject to any disclaimer, the term of this patent is extended or adjusted under 35 U.S.C. 154(b) by 146 days.

(21) Appl. No.: 14/329,965

(22) Filed: Jul. 13, 2014

Related U.S. Application Data

(60) Provisional application No. 61/879,974, filed on Sep. 19, 2013.

(51) Int. Cl.
*H04R 19/04* (2006.01)
*G10H 3/14* (2006.01)
*H04R 1/02* (2006.01)

(52) U.S. Cl.
CPC . *G10H 3/14* (2013.01); *H04R 1/02* (2013.01)

(58) Field of Classification Search
CPC H04R 3/00; H04R 19/005; H04R 2201/003; H04R 19/04; H04R 1/08; H04R 17/02; H04R 2499/11; H04R 1/04; H04R 3/005; H04R 2410/00; H04R 2201/02; H04R 1/02; H04R 1/021; H04R 1/025; H04R 1/083; H04R 1/406
USPC ..... 381/87, 91, 111–118, 122, 345, 386, 381/393–394; 181/198
See application file for complete search history.

(56) References Cited

U.S. PATENT DOCUMENTS 4,495,641 A * 1/1985 Vernino ..... G10H 3/146 381/162

* cited by examiner

*Primary Examiner* — Rasha Al Aubaidi
(74) *Attorney, Agent, or Firm* — William L. Chapin

(57) ABSTRACT

An acoustic pickup transducer device for converting sounds produced by a musical instrument into electrical signals proportional in amplitude and frequency to the instrument sounds includes a housing which has protruding therefrom a suction cup for removably attaching the device to an instrument, and a microphone interconnected through interface circuitry including a volume control potentiometer within the housing to an audio output signal jack. In a preferred embodiment, the microphone is fastened to the outer end of a flexible "gooseneck" stalk which extends from the housing at an angle adjustable by manually bending the stalk to a desired shape, which is retained by a bent wire within the stalk, thus enabling adjustment of the direction of peak sound responsivity or directivity over a wide range of angles. Preferably, the microphone is an electret type supplied with a D.C. bias voltage by a coin-cell battery within the housing.

16 Claims, 13 Drawing Sheets

ADJUSTABLE DIRECTIVITY ACOUSTIC PICKUP FOR MUSICAL INSTRUMENTS

This application claims priority of and to provisional application No. 61/879,974, filed Sep. 19, 2013.

BACKGROUND OF THE INVENTION

A. Field of the Invention

The present invention relates to accessories for musical instruments. More particularly, the invention relates to a versatile acoustic pickup for converting musical sounds to electronic signals, which is quickly attachable to and removable from a wide variety of musical instruments, and has a sound directivity that is easily adjustable over a wide range of orientations relative to an instrument to which it is attached.

B. Description of Background Art

There are a wide variety of musical instruments which may be optionally equipped with a transducer or "pickup" to convert musical sounds produced by the instrument to electrical signals. Typically, the electrical signals output from a pickup are input to an amplifier, and amplified to a level sufficient to drive a loudspeaker. The signals may also be input to an analog or digital recording device.

Musical instruments which may utilize sound pickups include drums and other percussion instruments, upright and double basses, autoharps, violins, cellos, acoustic guitars, 12-string guitars, dulcimers, tenor banjos, resonator guitars, gypsy jazz guitars, mandolins, accordions, and keyboards, as well as other instruments.

One type of musical instrument pickup which has been in extensive use for many years is a magnetic pickup used on guitars, which produces electrical signals in response to motions of a vibrating guitar string in the vicinity of a magnetic field produced by the pickup. Such pickups are used primarily with guitars and other stringed instruments, must be positioned precisely in close proximity to strings, and usually require permanent or semi-permanent attachment to a musical instrument.

Another type of pickup in common use with musical instruments includes a vibration-sensitive device such as a piezoelectric sensor which is fastened to the soundboard of a stringed instrument, or to the shell or other part of a percussion instrument such as a drum, and produces electrical output signals proportional to the amplitude and frequency of vibrations of the soundboard, drumhead, or drum body caused by sounds produced by the instrument. Vibration sensitive pickups of the type described above require careful positioning, and oftentimes permanent or semi-permanent attachment to a musical instrument.

A third type of pickup used with musical instruments, and which may be referred to generally as an acoustic pickup, consists essentially of a microphone which is attachable to various parts of a musical instrument such as a stringed instrument, drum, or other percussion instrument.

Acoustic pickups are in relatively widespread use, but there are problems with the present generation of such devices. The problems include large size, cumbersomeness, difficulty of mounting the pickup to a musical instrument, and undesirable feedback of vibrations of the instrument to the device, which by design preferably would respond primarily to acoustic signals transmitted through the air rather than vibrations transmitted through the body of an instrument.

Another problem with existing acoustic pickups for musical instruments is the difficulty with which the sound directivity of the pickup may be adjusted, and a requirement that typical current generation pickups must be permanently or semi-permanently attached to a musical instrument. The adjustable directivity pickup for musical instruments according to the present invention was developed by the present inventor to address problems of the type described above encountered with present generation pickups.

OBJECTS OF THE INVENTION

An object of the present invention is to provide an adjustable directivity acoustic pickup for musical instruments.

Another object of the present invention is to provide an adjustable directivity acoustic pickup for musical instruments which is quickly and easily attachable to a variety of musical instruments without requiring that holes be made in the instrument, or that the instrument be otherwise defaced.

Another object of the invention is to provide an adjustable directivity acoustic pickup for musical instruments which has a peak acoustic response direction angle that is quickly and easily adjustable without the use of tools, by removing the pickup from an instrument, re-orienting the pickup, and re-attaching the pickup to the instrument.

Another object of the invention is to provide an adjustable directivity acoustic pickup for musical instruments which has a sound response directivity that is adjustable over a first range of polar angles relative to a musical instrument by positioning the body of the pickup at a desired polar angle relative to an instrument, and adjustable over a second range of polar angles and a range of inclination angles by orienting a flexible microphone support member of the pickup at various polar and elevation angles.

Another object of the invention is to provide an adjustable directivity acoustic pickup for musical instruments which has a fastening member that facilitates quick and easy attachment, removal and re-positioning, and re-attachment to a musical instrument, and which also isolates the pickup from responding to vibration of the instrument.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an adjustable directivity acoustic transducer, or pickup device, for converting sounds produced by a musical instrument to electrical signals. The novel design and construction of the pickup device according to the present invention enables the device to be easily attachable to and removable from a wide variety of string and percussion instruments. Moreover, the novel design and construction of the pickup device according to the present invention enables the sound directivity of the device relative to sound-producing elements of a musical instrument to which it is attached to be quickly an easily adjusted over a wide range of direction angles, without requiring the use of tools, drilling holes in the instrument, or otherwise defacing the instrument.

A basic embodiment of an adjustable directivity acoustic pickup device for musical instruments according to the present invention has generally the form of a small, rectangularly shaped box or housing which has protruding from a flat lower base wall thereof a suction cup fastener that is removably attachable to a flat surface such as a soundboard of a musical instrument, by pressing the lower surface of the suction cup into hermetically sealing contact with the surface.

The pickup device according to the present invention includes a microphone, preferably an electret type microphone, which is powered by a small lithium-ion, button-cell type battery held in a battery holder located within the housing. The pickup device has an electrical output jack which is connected in series with the microphone and the wiper of a potentiometer that is connected to the microphone and receives electrical signals output from the microphone in response to sound waves received by the microphone. In a preferred embodiment, the output jack is a switch-type phono jack that has a normally open internal switch which is closed by inserting an input plug of an audio output signal cable into the jack. The switch terminals are connected in a series with the battery and microphone, thus applying D.C. power to the microphone only when an audio signal plug is inserted into the jack.

In a preferred embodiment of an acoustic pickup device according to the present invention, the electret microphone is fastened to the outer end of a flexible "gooseneck" stalk. The inner end of the stalk extends through a rear side wall into an interior space in the housing. A pair of flexible insulated wires which run through a passageway or lumen disposed through the length of the stalk interconnects terminals of the electret microphone with electrical circuitry located within the interior space of the housing.

The novel construction of the pickup device according to the present invention enables it to be quickly and easily attached to a flat surface such as the soundboard of a guitar or other musical instrument. Attachment is made by first orienting the housing of the pickup device so that the rear side wall and microphone stalk are positioned at a desired polar angle relative to the mounting surface of an instrument.

For example, if the pickup device is to be attached to the soundboard of a guitar, the pickup device may be positioned between an outer peripheral edge of the soundboard and the strings, with the back, microphone-side of the housing facing in the direction of the strings. The pickup device may then be grasped and pivoted about a normal vertical axis perpendicular to the upper side panel wall of the pickup housing, to thereby adjust the rear, microphone-side panel wall to a desired polar angle relative to the instrument strings.

After orienting the acoustic pickup device relative to a musical instrument as described above, the suction cup base of the device is placed in contact with the instrument surface and finger pressure applied downwards to the upper side of the device to thus deform and hermetically fasten the suction cup to the instrument surface.

From the foregoing description it may be understood that the rear panel wall and microphone may be oriented over a range of polar angles on the surface of a musical instrument. The housing may be rotated about a vertical axis through the suction cup to any polar angle, i.e. over a range of 360 degrees. As a practical matter, the audio signal output jack and signal output cable attached to the pickup device would generally be oriented to face an outer edge of the instrument so that the cable may be deployed away from the instrument and connected to an amplifier. Consequently, a practical adjustability range of polar angles would be limited to a value of, for example, about 90 degrees. This smaller range of polar angle adjustability would in any event be more than adequate for many applications.

In a preferred embodiment of the pickup device with a flexible stalk supporting the microphone, a perpendicular normal collinear with the longitudinal axis of the microphone, which determines the direction of peak sound responsivity, or directivity, may be flexibly adjustable over a second range of polar angles. This second range is in addition to the range provided by orienting the device housing to a particular polar angle relative to a musical instrument. The stalk may also be flexed to position and hold the microphone at various inclination angles relative to the surface of a musical instrument.

Also, the microphone stalk may be flexed in a vertical direction to adjustably position the microphone located at the outer end of the stalk at different distances from the device housing. This additional degree of vertical adjustability enables adjustment of the distance between the microphone relative to sound-producing elements such as vibrating strings.

A simplified embodiment of an adjustable directivity acoustic pickup for musical instruments according to the present invention eliminates the flexible microphone stalk. In this embodiment, an electret microphone is mounted in the rear panel wall of the device housing, preferably with the longitudinal axis of the microphone which coincides with its direction of peak sound responsivity perpendicular to the rear panel wall. As may be understood by referring to the description of the basic embodiment of the pickup device given above, the modified embodiment of the pickup device has a sound directivity which is adjustable over a range of polar angles at least as large as 90 degrees.

DESCRIPTION OF THE PREFERRED EMBODIMENTS

Figure 8:
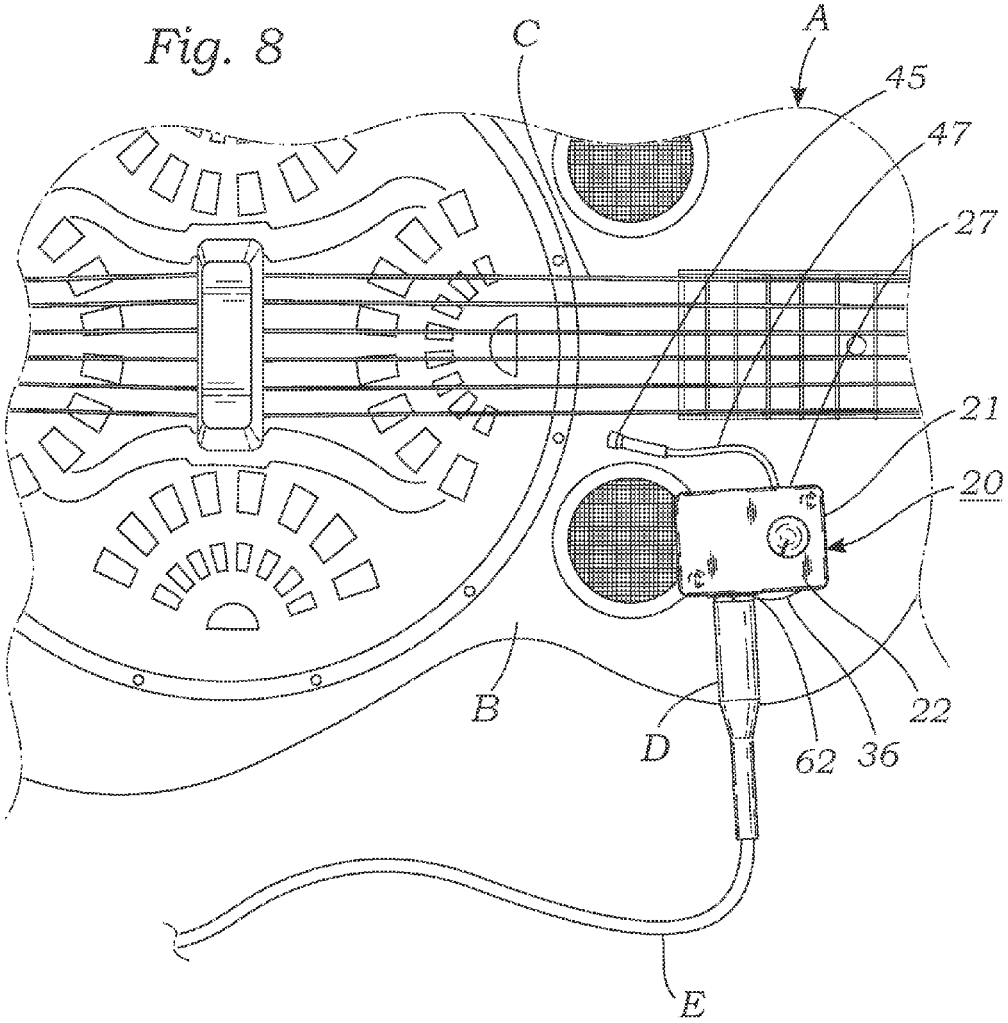
FIG. 8 is a perspective view on a reduced scale of the pickup device of FIG. 1, showing the device mounted to a self-resonator guitar in correct size relationship to the guitar.
Figure 9:
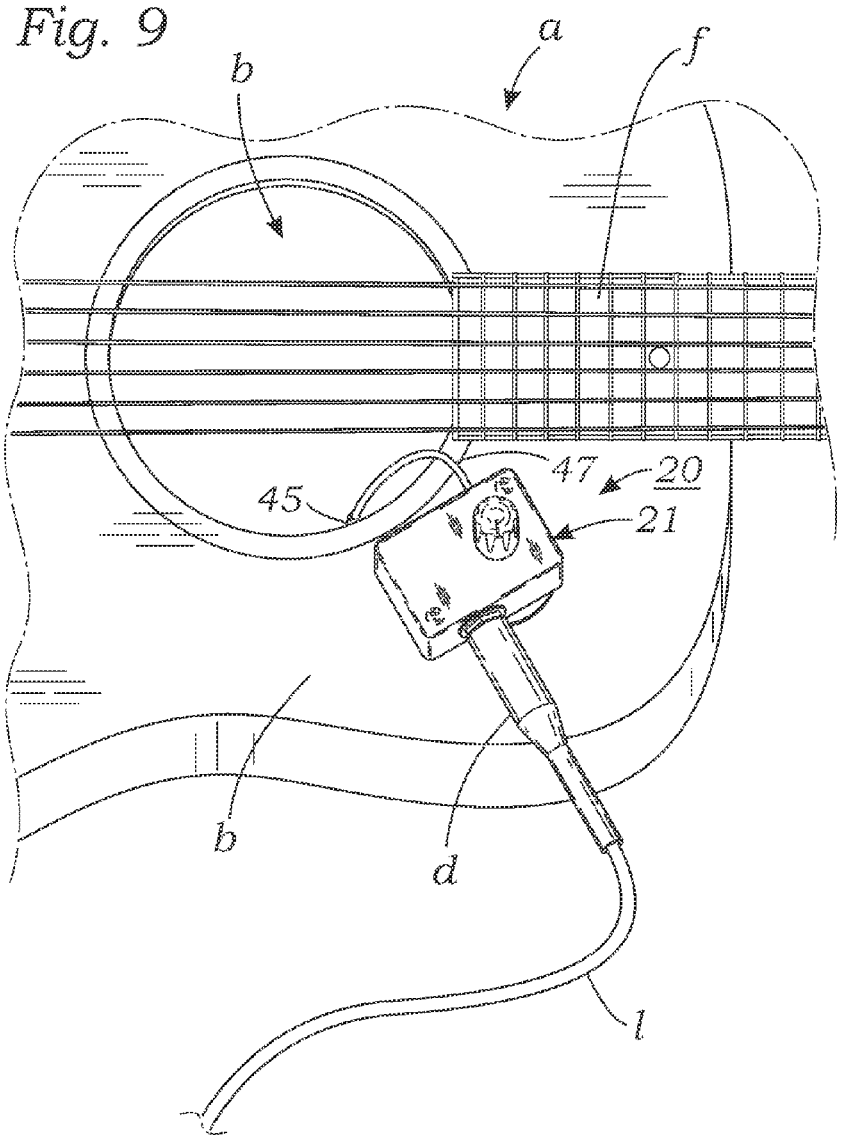
FIG. 9 is a perspective view on a reduced scale of the pickup device of FIG. 1, showing the device mounted to a 12-string guitar in correct size relationship to the guitar.
Figure 10:
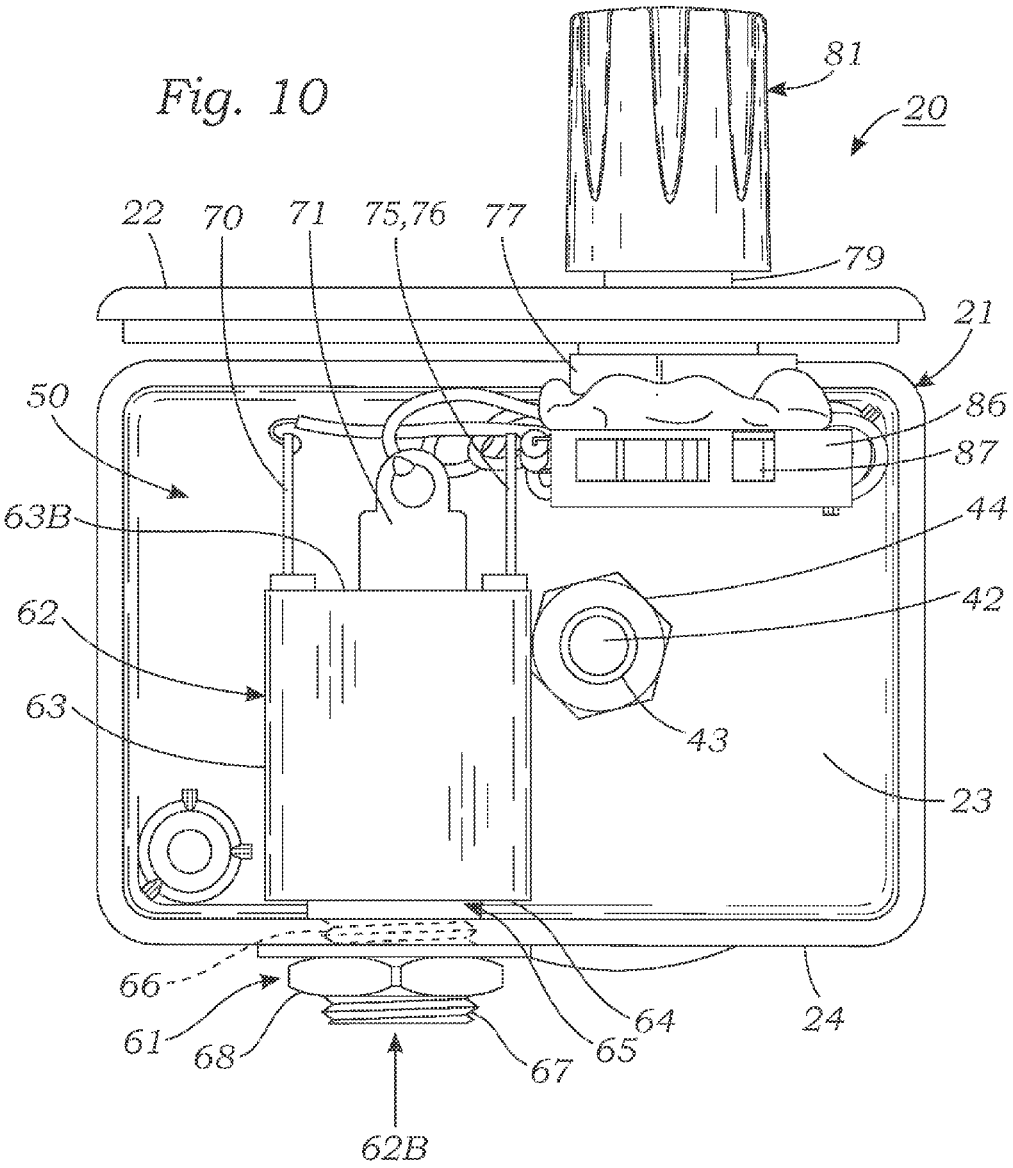
FIG. 10 is a partially disassembled upper plan view of the pickup device of FIG. 9 showing the mounting of the button cell battery and holder on the potentiometer housing.
Figure 11:
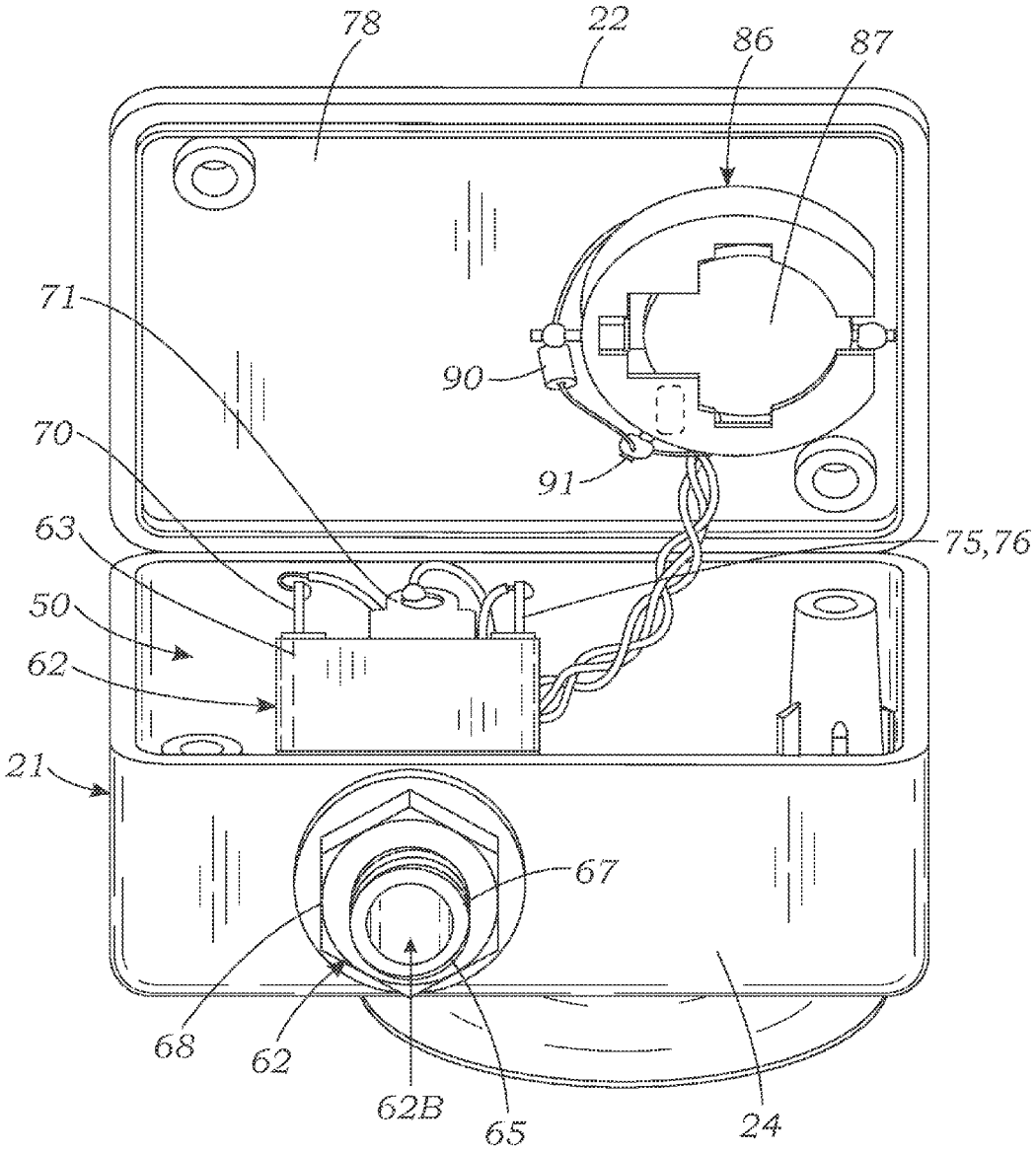
FIG. 11 is a partially disassembled upper front perspective view of the pickup device of FIG. 1, showing lid-fastening screws of the device removed and the lid tilted backwards to reveal a button battery and holder of the device.
Figure 12:
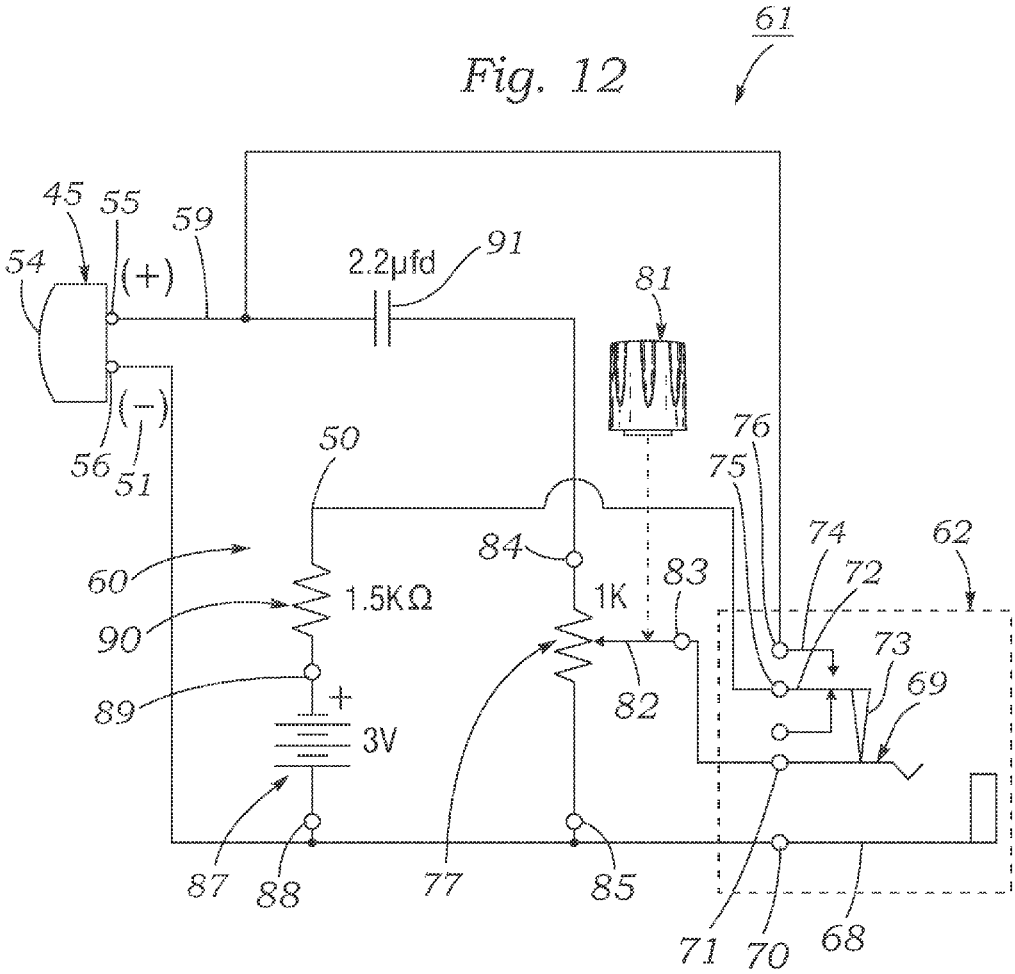
FIG. 12 is an electrical schematic diagram of the pickup device of FIG. 1.

FIGS. 1-7D illustrate a basic embodiment of an adjustable directivity acoustic pickup device for musical instruments according to the present invention. FIGS. 8 and 9 show the device of FIGS. 1-7D mounted to two different type stringed musical instruments. FIGS. 10 and 11 illustrate details of the construction of the pickup device of FIGS. 1-9. FIG. 12 is an electrical schematic diagram of the device of FIGS. 1-11.

As shown in FIGS. 1-7D, a basic embodiment 20 of an acoustic pickup device according to the present invention includes a thin, rectangular box-shaped housing 21. Housing 21 has a rectangular, flat upper panel wall 22, and a lower panel wall 23 which is parallel to the upper panel wall and has the same size and shape.

Figure 1:
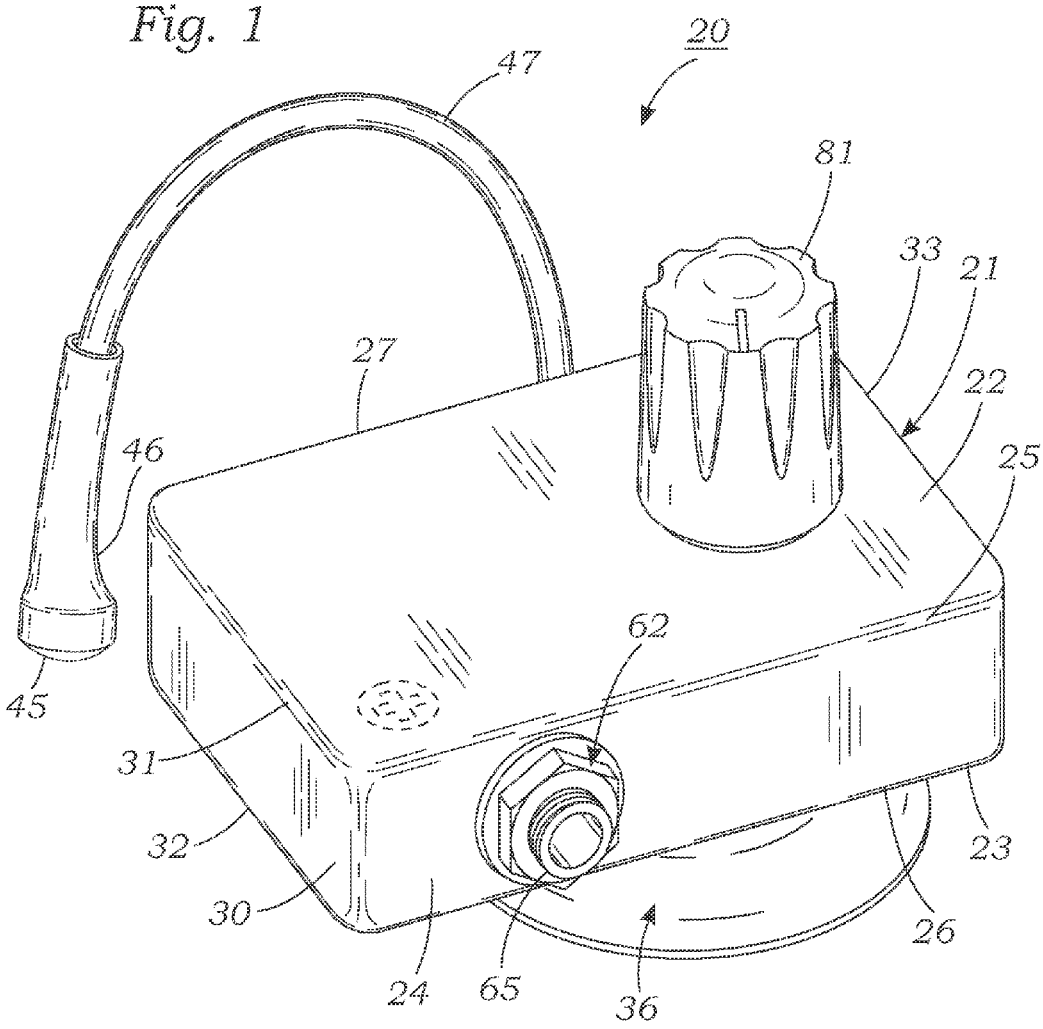
FIG. 1 is a perspective view on an enlarged scale of an Adjustable Directivity Pickup for Musical Instruments according to the present invention.
Figure 2:
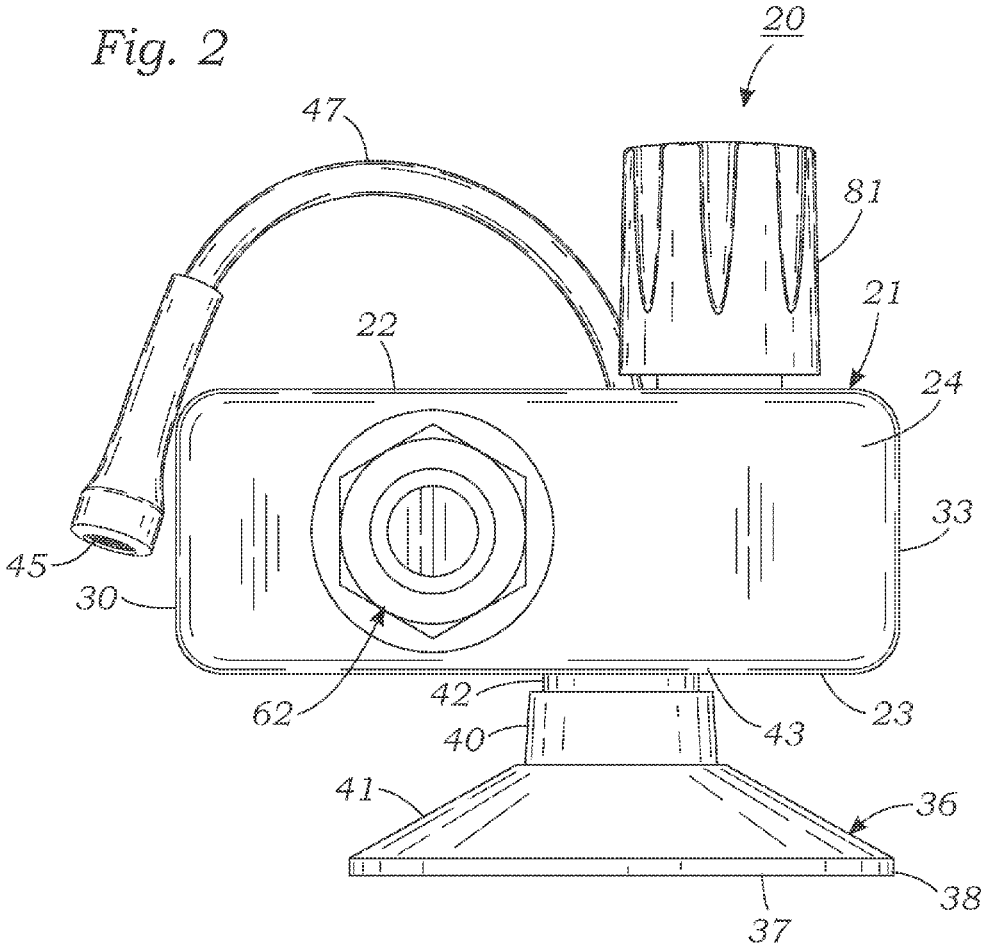
FIG. 2 is a front elevation view of the pickup device of FIG. 1.
Figure 3:
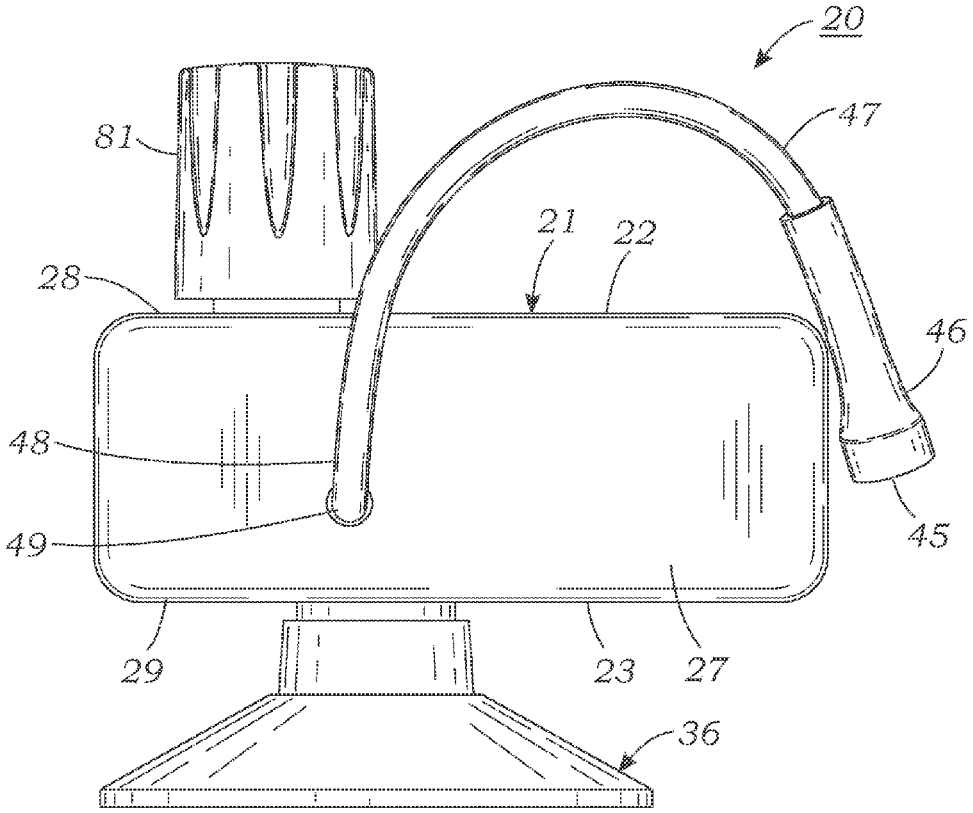
FIG. 3 is a rear elevation view of the pickup device of FIG. 1.

As is also shown in FIGS. 1-7D, housing 21 of pickup device 20 has a short, flat laterally elongated rectangular front panel wall 24 which is disposed perpendicularly between the front edge 25 of upper panel wall 22, and the front edge 26 of lower panel wall 23. As shown in FIG. 2, housing 21 of device 20 also has a rear panel wall 27 which is parallel to and has the same size and shape as front panel wall 24. Rear panel wall 27 is disposed perpendicularly between the rear edge 28 of upper panel wall 22, and the rear edge 29 of lower panel wall 23.

Referring again to FIG. 1, it may be seen that housing 21 of device 20 has a short, laterally elongated, rectangularly shaped left side panel wall 30. Left side panel wall 30 has the same height as front and rear panel walls 24 and 27, and is disposed perpendicularly between the left edge 31 of upper panel wall 22, and the left edge 32 of lower panel wall 23.

Figure 4:
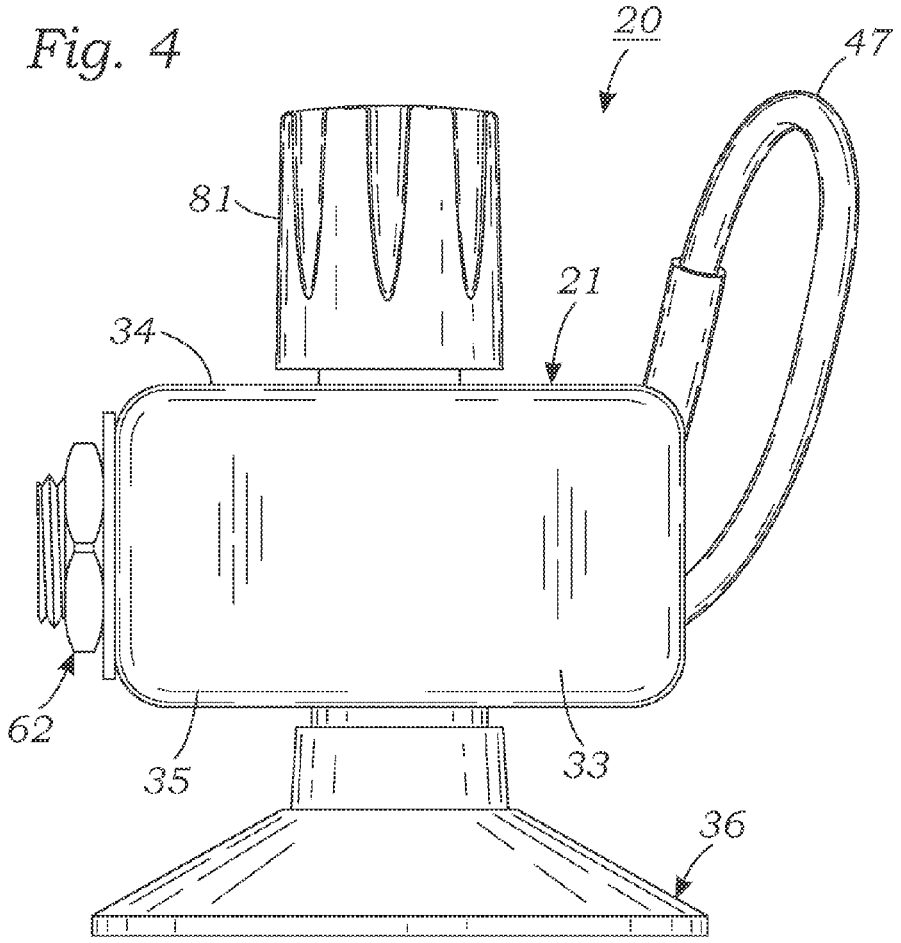
FIG. 4 is a right side elevation view of the pickup device of FIG. 1.
Figure 5:
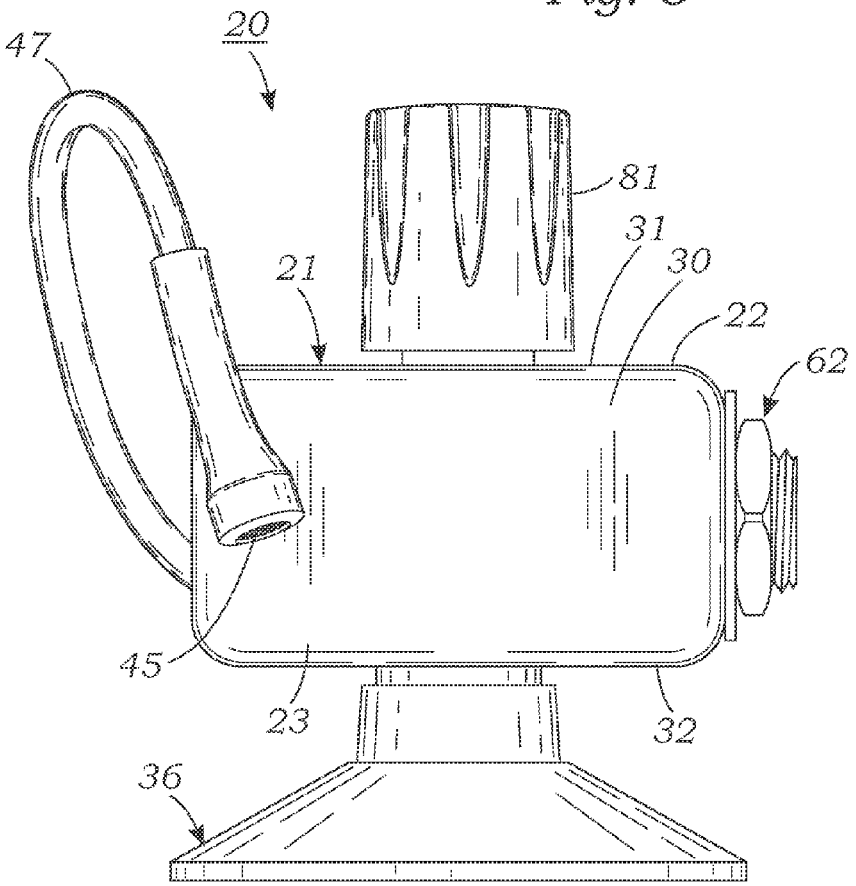
FIG. 5 is a left side elevation view of the pickup device of FIG. 1.
Figure 6:
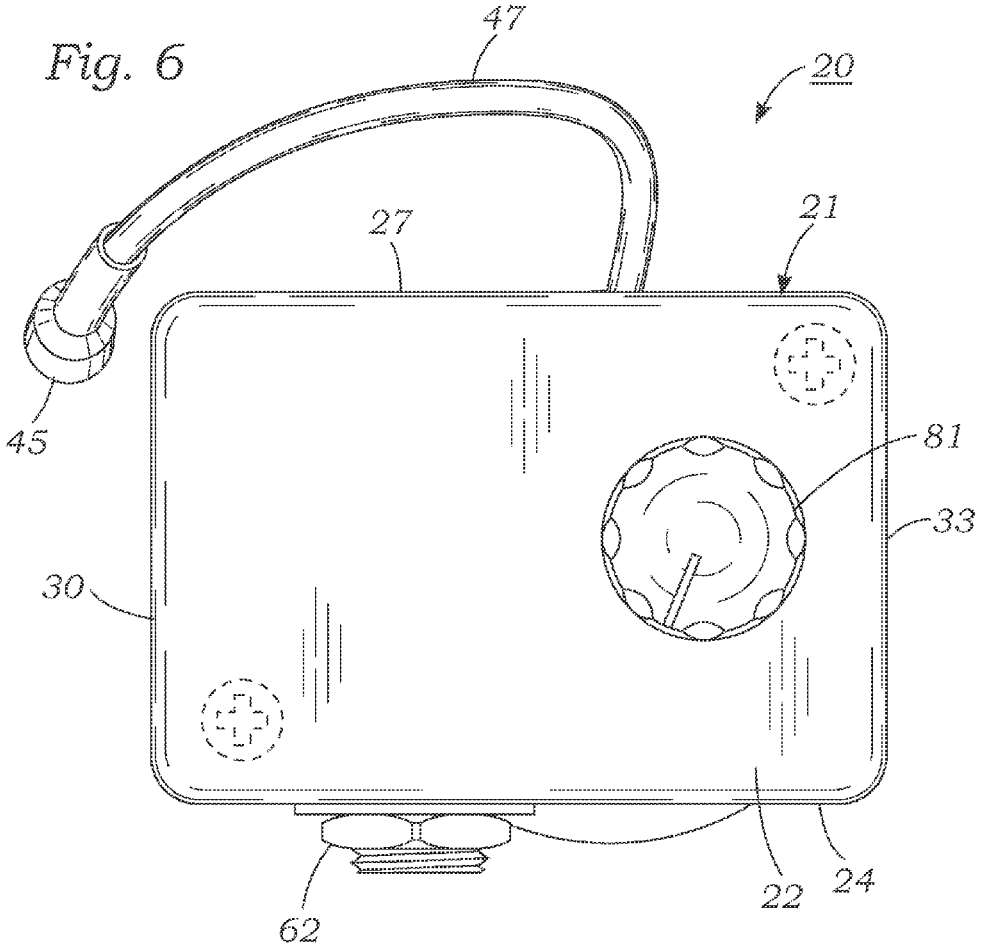
FIG. 6 is an upper plan view of the pickup device of FIG. 1.

As shown in FIGS. 1 and 4, housing 21 of pickup device 20 also has a short, laterally elongated right side panel wall 33. Right side panel wall 33 is parallel to and has the same size and shape as left side panel wall 30, and is disposed perpendicularly between the right edge 34 of upper panel wall 22, and the right edge 35 of lower panel wall 23.

As may be seen by referring to FIGS. 1-5 and 7A, pickup device 20 includes a suction cup fastener 36 which protrudes downwards from lower panel wall 23. Suction cup fastener 36 includes an upwardly concave lenticular-shaped base 37 which is made of an elastomeric material such as a natural or synthetic rubber. Base 37 has a flat lower outer annular ring-shaped peripheral sealing surface 38 which peripherally circumscribes a concave suction cavity 39 within the base.

As shown in FIGS. 2-5, suction cup fastener 36 also has a cylindrically-shaped neck 40 which extends coaxially upwards from upper convex wall 41 of base 37. Neck 40 is attached coaxially to a stud 42. As shown in FIGS. 2 and 10, stud 42 protrudes upwards through a hole 43 in lower panel wall 23, and is secured to the lower panel wall by a hexagonal ring nut 44.

Referring to FIGS. 1-7D, pickup device 20 may be seen to include a microphone 45 which is fastened to the outer, distal end 46 of a flexible tubular stalk 47. The inner, proximal end 48 of stalk 47 is disposed through a perforation 49 in rear panel wall 27 into a hollow interior space 50 of housing 21.

As shown in FIGS. 1-7D, microphone 45 includes a small cylindrically-shaped body 51 held within a tubular sheath 52 made of an electrically non-conductive material such as 2:1 heat-shrinkable insulated tubing. Body 51 of microphone 45 has at an outer end thereof a circular, transversely disposed, circular perforated screen 53. Perforations 54 in screen 53 permit the transit therethrough of sound pressure waves which are effective in producing at microphone output terminals 55, 56 electrical output signals proportional in frequency and amplitude to sound waves received by the microphone.

Figure 7A:
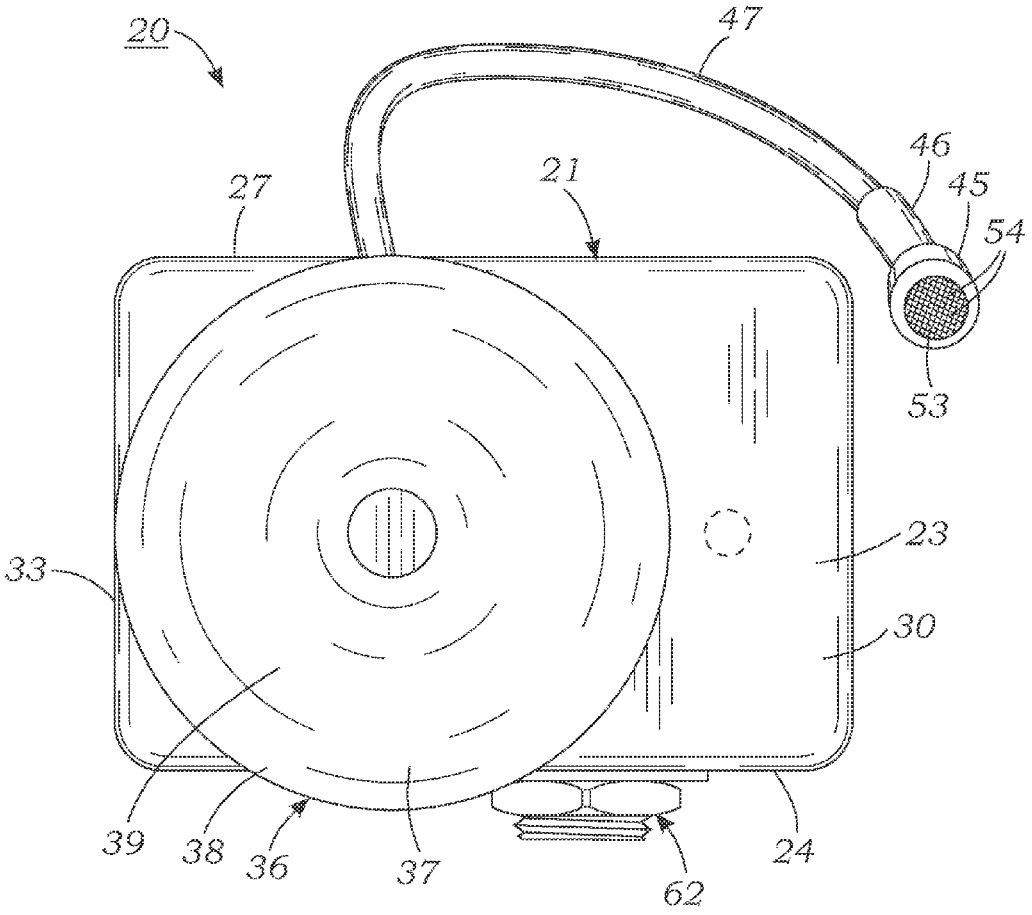
FIG. 7A is a lower plan view of the pickup device of FIG. 1.
Figure 7B:
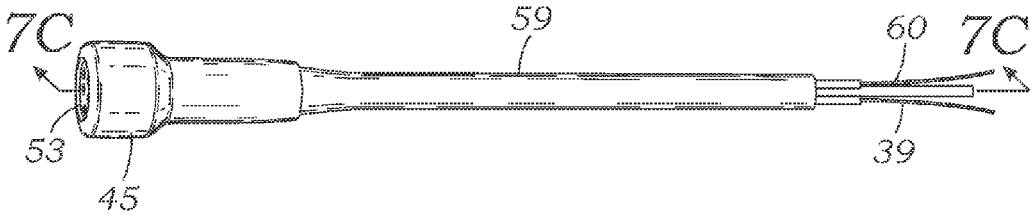
FIG. 7B is a fragmentary view showing on an enlarged scale a microphone and bendable support stalk component of the device of FIG. 1.
Figure 7C:
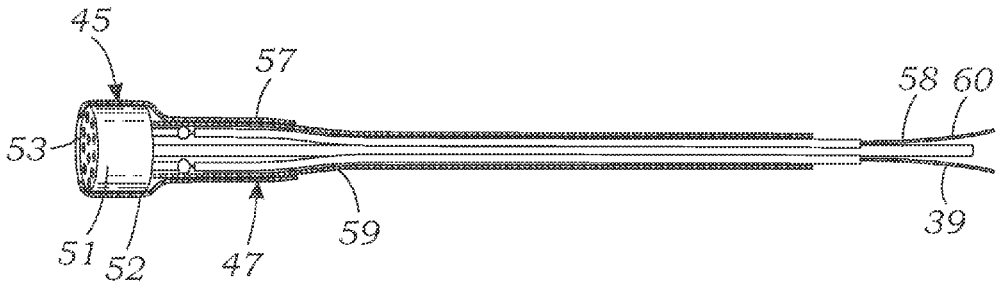
FIG. 7C is a longitudinal sectional view of the microphone and bendable support stalk component of FIG. 7B.
Figure 7D:
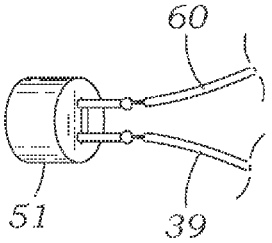
FIG. 7D is fragmentary view of the microphone and bendable support stalk component of FIG. 7B, showing on an enlarged scale a microphone component thereof.

As shown in FIGS. 7B and 7C microphone support stalk 47 has generally the shape of a circular cross-section, uniform diameter flexible tube made of an electrically non-conductive material such as 2:1 heat-shrinkable insulated tubing which has disposed through its length a bore or lumen 57. Bore 57 has disposed through its length a bendable, shape-retaining wire 58 made of 0.032-inch diameter soft-tempered stainless-steel wire With this construction, stalk 47 may be manually bent into different serpentine shapes, which are retained by bent wire 58.

As may be understood by referring to FIGS. 6 and 10-12, bore 57 through stalk 57 also contains therein a pair of flexible insulated electrical microphone wires 59 and 60 which are disposed through the length of the bore. Microphone wires 59, 60 are connected at outer ends thereof to microphone terminals 55, 56, respectively. Inner ends of wires 59, 60 are electrically conductively connected to electrical circuitry 61 located within hollow interior space 50 of housing 21. The structure and function of circuits 61 will be described below.

Referring to FIGS. 1 and 10-12, it may be seen that pickup device 20 includes an audio signal output connector 62. Output connector 62 may be of any suitable type electrical connector which has at least two conductors. Preferably, output connector 62 is a standard type audio connector jack such as a ¼-inch, phono plug-in jack. In a most preferred embodiment, connector 62 consists of a ¼-inch phono jack which includes an internal normally open switch that closes a circuit in response to insertion of a plug into the jack.

As shown in FIGS. 1 and 10-12, phono jack connector 62 includes a rectangular block-shaped body 63 that has protruding forward from a front wall 64 thereof a hollow circular cross-section bushing 65. Bushing 65 protrudes outwards through a mounting hole 66 through front panel 24 of housing 21.

As shown in FIGS. 10 and 11, bushing 65 has an external helically-threaded surface 67. Connector jack 62 is fastened to front panel 29 of housing 21 by threadingly tightening a hexagonal ring nut 68 onto threaded surface 67 of bushing 65.

As shown in FIGS. 11 and 12, connector jack 62 has an outer electrically conductive, cylindrical shell-shaped ground conductor 68. Jack 62 also has within a bore 62B which extends coaxially inwards from the outer transverse end of shell 68 an internal center conductor 69 which consists of a conductive metal spring strip. Outer, ground conductor shell 68 and center conductor strip 69 are electrically connected to signal terminals 70, 71, respectively, which protrude from rear wall 63B connector body 63.

As may be seen best by referring to FIG. 12, connector jack 62 also contains an internal switch which includes an electrically conductive spring strip 72. Switch spring strip 72 is mechanically coupled by an insulating bar 73 to center conductor spring strip 69. When center conductor spring strip 69 is pushed radially outwards by an audio signal plug inserted into connector jack 62, conductive switch spring strip 72 is pivoted radially outwards, and brought into electrically conductive contact with a fixed normally open switch contact 74. Pivotable switch spring strip conductor 72 and normally open switch contact 74 are electrically connected to switch terminals 75, 76, respectively, that protrude from rear wall 63B of connector body 63.

As shown in FIGS. 1 and 10-12, electrical circuitry 61 of pickup device 20 includes a potentiometer 77 which is mounted to the upper panel wall 22 of housing 21. Potentiometer 77 has a shaft 79 which protrudes outwards through a hole 80 in the upper panel wall. A knob 81 attached to potentiometer shaft 79 enables the shaft and a wiper 82 of potentiometer 77 to be turned to various angular positions to thereby adjust the value of electrical resistance between wiper output terminal 83 and input terminals 84 and 85 of the potentiometer.

As shown in FIGS. 10-12, pickup device 20 includes a battery holder 86 that includes a replaceable 3-volt lithium-ion, coin-cell type battery 87. Battery holder 86 has a negative output terminal 88 which is connected to a common ground conductor of circuitry 61, and a positive output terminal 89.

As shown in FIG. 12, positive output terminal 89 of battery holder 86 is connected through a series current-limiting resistor 90 to transfer contact switch terminal 75 of connector jack 62. Also, normally open switch terminal 76 of jack 62 is connected to the positive terminal 55 of electret microphone 45. Consequently, when an audio plug is inserted into jack 82, a 3-volt D.C. bias voltage is applied to electret microphone 45.

As shown in FIGS. 11 and 12, circuitry 61 of pickup device 20 also includes a capacitor 91 connected in series with positive output terminal 55 of microphone 45, and upper input terminal 84 of potentiometer 77. Capacitor 91 isolates the D.C. bias voltage supplied by battery 87 to microphone 77 from potentiometer 77 and provides a low impedance path for conducting alternating frequency audio signals from the microphone to the potentiometer.

As can be readily understood by referring to FIG. 12, the amplitude of audio signals output from electret microphone and conducted to center output leaf conductor 69 of connector jack 62 can be varied between 0 and 100 percent by turning potentiometer knob 81 between counterclockwise and clockwise limit positions.

FIGS. 8 and 9 illustrate how acoustic pickup device 20 may be quickly and easily attached to and removed from various types of musical instruments, and how the sound directivity of the device may be readily adjusted.

In an example application of acoustic pickup device 20 according to the present invention shown in FIG. 8, the acoustic pickup device is attached to the soundboard B of a self-resonator type guitar A. Attachment of the device at a desired polar or azimuth angle on the to soundboard B, placing the suction cup fastener 36 in contact with the soundboard, and then applying a slight finger pressure downwards on the upper surface of upper panel wall 22 of the device housing. This pressure causes the base cup 37 of suction cup fastener 36 to be resiliently deformed into hermetically sealing contact with soundboard B, thus securing the device to the soundboard.

As may be understood by referring to FIG. 8, acoustic pickup device 20 may be positioned with rear wall 27 of device housing 21 and thus microphone support stalk 47 and microphone 45 at a desired position on soundboard B. For example, as shown in FIG. 8, the housing 21 of pickup device 20 is oriented to position the microphone 45 facing the strings C of guitar A.

As may also be understood by referring to FIG. 8, the proximity of microphone 45 to sound-producing elements such as strings C of a musical instrument may readily be adjusted by bending microphone stalk 47 into a desired shape. Moreover, the direction of maximum response to sounds produced by guitar A or other such musical instrument, which direction coincides with a perpendicular normal to microphone screen 53, may be readily adjusted in inclination or elevation angle, and polar or azimuth angle, by bending stalk 47 into a desired contour.

As is shown in FIG. 8, with pickup device 20 adjustably mounted to soundboard B of guitar A, an input plug D at an input end of an audio signal cable E may be inserted into jack 62. The output end of cable E would typically be connected to an audio amplifier (not shown).

FIG. 9 illustrates how acoustic pickup device 20 may be readily removed from a musical instrument such as the self-resonating guitar A shown in FIG. 8, and removably attached to a different instrument, such as the 12-string guitar a shown in FIG. 9.

Thus as shown in FIG. 9, the polar angle of housing 21 of acoustic pickup device 20 is oriented obliquely with respect to the longitudinal axis of 12-string guitar a., rather than parallel to the longitudinal axis of self-resonator guitar A, as shown in FIG. 8. Also, in the application shown in FIG. 9, microphone stalk 47 is bent to position microphone 45 at the outer end of the stalk near or actually within the sound hole or "rose" f of guitar a.

As those skilled in the art will recognize, the novel advantages of the acoustic pickup device described above will be retained in variations of the device. For example, the four side walls which form a rectangular ring shape may be replaced with a single continuous peripheral wall which has a circular, oval, or other shape.

What is claimed is:

1. An acoustic pickup transducer device for use with musical instruments, said pickup device comprising;

a. a housing having an upper wall, a lower wall, and at least one peripheral wall disposed between said upper wall and lower wall, b. a microphone, c. a flexible microphone support stalk fixed at a proximal end thereof to said housing and having a distal end which supports said microphone at adjustable distances from and orientations with respect to said housing, d. electrical interface circuitry within said housing, said electrical interface circuitry having an input port connected to said microphone and an output port, e. an electrical signal output connector connected to an output port of said electrical interface circuitry, and f. a fastener for fastening said housing to a musical instrument.

2. The pickup device of claim 1 wherein said fastener is a suction cup.

3. The pickup device of claim 1 wherein said electrical output connector is mounted in a wall of said housing.

4. The pickup device of claim 1 wherein said electrical interface circuitry includes a volume control potentiometer, said potentiometer having a control shaft which protrudes through a wall of said housing.

5. The pickup device of claim 1 wherein said fastener includes at least one of a hook-and-loop fastener member, an adhesive fastener member, and a replaceably removable suction cup.

6. An acoustic pickup transducer device for use with musical instruments, said device comprising;

a. a housing having an upper wall, a base wall below said upper wall, and a peripheral wall disposed between said upper wall and said base wall, b. a microphone, c. a flexible microphone support stalk fixed at a proximal end thereof to said housing and having a distal end which supports said microphone at adjustable distances from and orientations with respect to said housing, d. electrical interface circuitry within said housing, said interface circuitry having an input port electrically connected to said microphone, and an output port, e. an electrical signal outlet connector electrically connected to said output port of said electrical interface circuitry, and f. a suction cup fastener which extends from said base wall of said housing.

7. The pickup device of claim 6 wherein said peripheral wall has a rectangular ring-shape, including a front wall, a rear wall, and left and right side walls.

8. The pickup device of claim 7 wherein said proximal end of said microphone support stalk is disposed through said rear wall of said housing.

9. The pickup device of claim 8 wherein said output connector is mounted in said front wall of said housing.

10. The pickup device of claim 6 wherein said electrical interface circuitry includes a volume control potentiometer operatively interconnected with said microphone and said electrical signal output jack, said potentiometer having a control shaft which protrudes through a wall of said housing.

11. The pickup device of claim 6 wherein said suction cup fastener is interchangeably replaceable by one of a hook-and-loop fastener, an adhesive fastener, and a magnetic fastener.

12. An acoustic pickup transducer device for use with musical instruments, said device comprising;

a. a housing having an upper wall, a base wall below said upper wall, and a peripheral wall disposed between said upper wall and said base wall, b. a flexible microphone support stalk which extends from one of said upper wall, said base wall, and said peripheral wall, said microphone support stalk containing a bendable shape-retaining member, said microphone support stalk having a proximal end connected to a wall of said housing, c. a microphone fastened to a distal end of said microphone support stalk, d. electrical interface circuitry within said housing, said electrical interface circuitry having an input port electrically connected to said microphone and a signal output port, e. an electrical signal output connector electrically connected to said signal output port of said electrical interface circuitry, and f. a suction cup fastener which extends from said base wall of said housing.

13. The pickup device of claim 12 wherein said flexible microphone support stalk includes a flexible elongated tube having disposed through its length a lumen or bore, insulated electrical wires disposed through said bore and connected at a distal end to said microphone, and at a proximal end to said electrical interface circuitry, and a shape-retaining bendable wire, disposed through said bore.

14. The pickup device of claim 12 wherein said microphone is an electret type microphone.

15. The pickup device of claim 14 wherein said electrical interface circuitry includes a battery for providing a D.C. bias voltage to said microphone.

16. The pickup device of claim 15 wherein said electrical interface circuitry includes a volume control potentiometer, said potentiometer being operatively interconnected between said microphone and said output connector and having a control shaft which protrudes from said housing.

* * * * *